US005345741A

United States Patent [19]

Slater et al.

[11] Patent Number: 5,345,741

[45] Date of Patent: Sep. 13, 1994

[54] SILT BLOCKAGE FOR CATCH BASINS

[75] Inventors: Howard O. Slater; James W. Slater, both of South Windsor, Conn.

[73] Assignee: J. & H. Slater Construction Co., Inc., South Windsor, Conn.

[21] Appl. No.: 127,702

[22] Filed: Sep. 27, 1993

Related U.S. Application Data

[63] Continuation of Ser. No. 833,076, Feb. 10, 1992, abandoned.

[51] Int. Cl.[5] ..... E03F 1/00

[52] U.S. Cl. ..... 52/646; 52/741.1; 210/164; 210/170; 404/5; 405/36

[58] Field of Search ..... 52/646, 169.5, 741.1; 405/36; 135/87, 900, 902; 5/93.2, 97, 98.1, 98.2, 98.3, 99.1; 404/2, 3, 4, 5; 210/163, 164, 170

[56] References Cited

U.S. PATENT DOCUMENTS

| | | | |
|---|---|---|---|
| 2,698,443 | 1/1955 | Ralick | 5/99.1 |
| 3,162,865 | 12/1964 | Tigrett | 5/99.1 |
| 3,183,527 | 5/1965 | Turner | 5/98.1 |
| 3,606,620 | 9/1971 | Glover | 5/99.1 |
| 4,376,318 | 3/1983 | Cirillo | 5/99.1 |
| 4,419,232 | 12/1983 | Arntyr et al. | 210/164 |

*Primary Examiner*—Michael Safavi
*Attorney, Agent, or Firm*—M. P. Williams

[57] ABSTRACT

A silt barrier includes a main frame (10) which is disposed horizontally over a catch basin which is to have silt blocked therefrom, the main frame (10) has end frames (24, 25) rotatable from a stored flat position into a vertical working position. A pair of wooden frames (26, 27, 30, 31) are lodged between the end frames (24, 25) and porous plastic silt barrier sheeting (48) is stapled (50–55) to the wooden frames, surrounding the entire structure. The silt barrier is clamped to the catch basin (41, 70) with j-bolts (38, 39).

15 Claims, 3 Drawing Sheets

SILT BLOCKAGE FOR CATCH BASINS

This is a continuation of application Ser. No. 07/833,076, filed Feb. 10, 1992, now abandoned.

TECHNICAL FIELD

This invention relates to securing vertical silt blockage about a catch basin to prevent the entry of silt thereto.

BACKGROUND ART

In any sort of construction work in which the earth is perturbed by any great amount, such as excavation for building foundations or altering topological grades, the use of silt barrier structures is required in most locations by state or local law. Originally, baled hay was used for this purpose. In recent years, it has become common to use porous plastic silt barrier sheeting erected with wooden fence posts. The fence posts are typically driven into the ground at regular intervals so as to support the sheeting in a vertical position against the pressure of the silt as it flows against one side of the sheeting and builds up or accumulates to increasing heights on the upstream side of the sheeting. The sheeting is porous, thereby allowing moisture to eventually pass through, while retaining the silt on the upstream side.

In any situation where there is paving, the driving of stakes is impossible, and making holes in the pavement to accommodate silt barrier stakes is generally not permitted. In many construction sites, all of the water will flow toward one or more catch basins (also referred to as storm drains and culverts), and the catch basin is typically located within a paved area where silt barrier stakes cannot be used. Typically, the silt barrier sheeting is simply placed horizontally, right over the catch basin, and weighted down with rocks or sand around the periphery. However, this method does not totally seal the catch basin and significant silt may pass under it. Additionally, it is almost impossible to clear away the silt when it is located right over the catch basin. Furthermore, there is a much greater tendency for the silt barrier sheeting to be ruptured when it is laying horizontally, unsupported over the grating of a catch basin. The foregoing problems are further compounded in the case of curbside catch basins which have an open throat extending vertically upward from the street level within the curb itself.

DISCLOSURE OF INVENTION

Objects of the invention include providing vertical silt blockage to catch basins, sealing silt barriers tightly around catch basins, providing vertical silt barriers to curbside catch basins, and providing silt barriers for catch basins utilizing readily available porous plastic silt barrier sheeting.

According to the present invention, a main frame which is clamped essentially horizontally above a catch basin when in use has end frames positioned vertically upward, perpendicular to its ends, and porous plastic silt barrier sheeting wrapped around the vertical frames above the periphery of the main frame. According to the invention further, a silt barrier subassembly includes a main frame having a pair of foldable end frames as well as centrally-disposed sockets for receiving vertically disposed wooden frame members which engage horizontally disposed wooden frame members that are sprung into place between the foldable end frames, when the end frames are erected into a vertical position for use.

According further to the invention, porous plastic silt barrier sheeting is stapled to the wooden members of the frame. In further accord with the invention, the sheeting is drawn beneath the frame on the underside thereof by means of the draw string provided therewith, thereby to ensure that the silt sheeting will not ride upwardly on the frame and permit passage of silt thereunder. In accordance still further with the invention, the vertical throat of a curbside silt basin is blocked with a slab of readily available material, such as plywood, either inside or outside of the silt barrier sheeting of a silt barrier assembly which is disposed tightly adjacent to the throat and clamped to the grating of the catch basin, thereby to block silt from entering either part of the catch basin.

The invention allows tightly sealing catch basins against the flow of silt by means of frames which are foldable so as to fit even in the trunk of an automobile. The frames use wood to allow stapling the silt barrier sheeting to the frame, and to allow use of material that is readily available on the construction site, such as grade stakes, silt barrier fence stakes or surveyor's stakes. The frames will last for years since the wooden part can be easily replaced on the job site, whenever necessary.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 3:
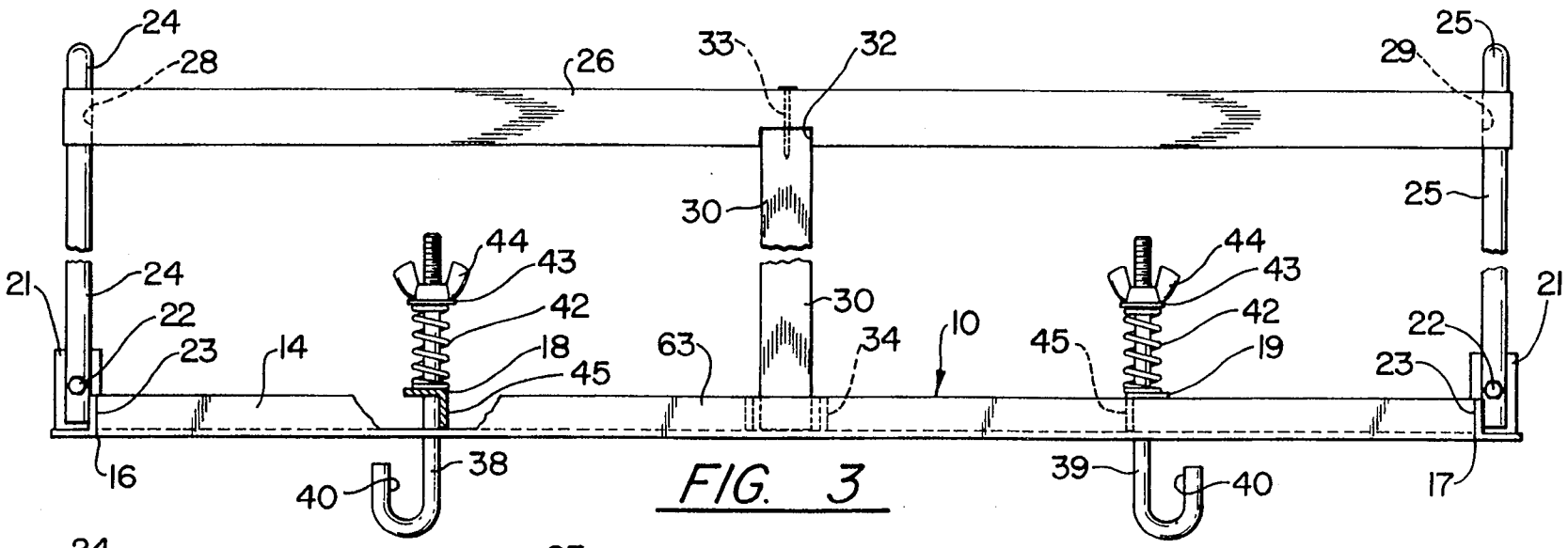
FIG. 3 is a partly sectioned, partly broken away side elevation view of a frame in accordance with the invention, having wooden frame members in place ready for use.

Referring to the drawing, a silt barrier fence incorporating the present invention includes a generally rectangular main frame 10 which, in use, is disposed generally horizontally above the grating of a catch basin. The main frame 10 comprises six pieces or rails of about one inch steel angle stock 14–19, which can be joined together suitably, such as by welding. The two end pieces 16, 17 each have a pair of brackets 21 disposed thereon in some suitable fashion such as by welding. Each of the brackets 21 has a hole therethrough to permit receiving a bolt and nut assembly 22, which rotatively mount corresponding end frames 24, 25. The end frames may typically comprise steel rod of about ½ inch or ⅝ inch diameter. The bolt assemblies 22 are disposed through the brackets 21 at a point which is just above (as seen in FIG. 3) the angle pieces 14–19. This permits the end frames 24, 25 to be folded downwardly into a non-use position so as to make the structure compact for storage and transport. For instance, the end frame 24 can rotate clockwise and the end frame 25 can rotate counterclockwise as seen in FIG. 3. On the other hand, the portion of the end frames 24, 25 below the bolt assemblies 22 (when in the use position as seen in FIG. 3) abut against the vertical walls 23 of the end pieces 16, 17 and therefore cannot rotate in the opposite directions: that is, the end frame 24 cannot rotate any further counterclockwise than as seen in FIG. 3, and the end frame 25 cannot rotate any further in the clockwise direction than as seen in FIG. 3.

Two longitudinal wooden frame members comprise horizontal wooden stakes 26, 27, each provided with a notch 28, 29 in the end thereof, which notch is sized to receive a corresponding one of the end frames 24, 25 therein. A feature of the invention is that one of the notches (28) can be slipped over one of the end frames (24) and the two end frames can then be spread open more than as seen in FIG. 3 so as to permit the other slot (29) to engage the other end frame (25). The springiness of the steel end frames 24, 25 will thereafter cause them to return to their upright positions and hold the wooden stakes 26, 27 snugly. The wooden stakes 26, 27 are registered to corresponding wooden vertical stakes 30, 31 such as by means of a nail 33 extending through a notch 32 and into the stakes 30, 31. The notch 32 provides lateral support to the stakes 30, 31. Because the length of the nails 33 are limited to less than the width of the longitudinal stakes 26, 27, the nails can be left in place after separating the stakes 30, 31 from the stakes 26, 27 without posing as great a hazard as would be the case without the notch. Of course, the use of a pin 33 without a notch 32 is also a possibility. The vertical wooden stakes 30, 31 may also, if desired, be registered to the horizontal wooden stakes 26, 27, such as by some other suitable registering means, as described with respect to FIG. 4 hereinafter. The bottoms of the vertical wooden stakes 30, 31 fit into sockets 34, 35 which may be simply formed of strap steel welded to the side members 14, 15. The stakes 26, 30 thus form a wooden frame member between a first corresponding side of the end frame members 24, 25, and the stakes 27, 31 form a wooden frame member between a second corresponding side of the end frame members 24, 25. The sockets 34, 35 are symmetrically disposed, being at the center of the side pieces 14, 15; if four sockets were used to accommodate four vertical stakes, they could be at thirds of the length of the side pieces 14, 15. Instead of sockets, pins fitting holes within the stakes 30, 31, or other suitable means may be used to register the stakes with the side rails.

To provide a means for securing the main frame 10 to a grating, each of the cross pieces 18, 19 has a hole 36, 37 near the center thereof (FIG. 2) which receives a corresponding j-bolt 38, 39 therein (FIG. 3). The j-bolts 38, 39 may simply comprise threaded rod having a hook portion 40 formed therein in a fashion suited to engaging the grating 41 of a catch basin, to which the frame of the invention is being attached to protect it from the flow of silt. Each j-bolt has a spring 42, a washer 43 and a wing nut 44; the spring 42 allows pushing the j-bolt down so that it can be engaged with the grating 42 and then holds the j-bolt up in place, against gravity, as the wing nut is then turned down compressing the spring and causing the j-bolt to secure (or clamp) the frame tightly to the grating 41. A feature is that the holes 36 are disposed immediately adjacent the vertical walls 45 of the angle pieces 18, 19, to restrict motion of the j-bolts when the frame is not in use, thereby reducing the likelihood that the j-bolts could fall out of their corresponding holes 36, 37 while in transit or storage. The cross pieces are symmetrically disposed (at thirds) along the side pieces 14, 15; a single cross piece might be used near the center, particularly for use with small catch basins.

Figure 1:
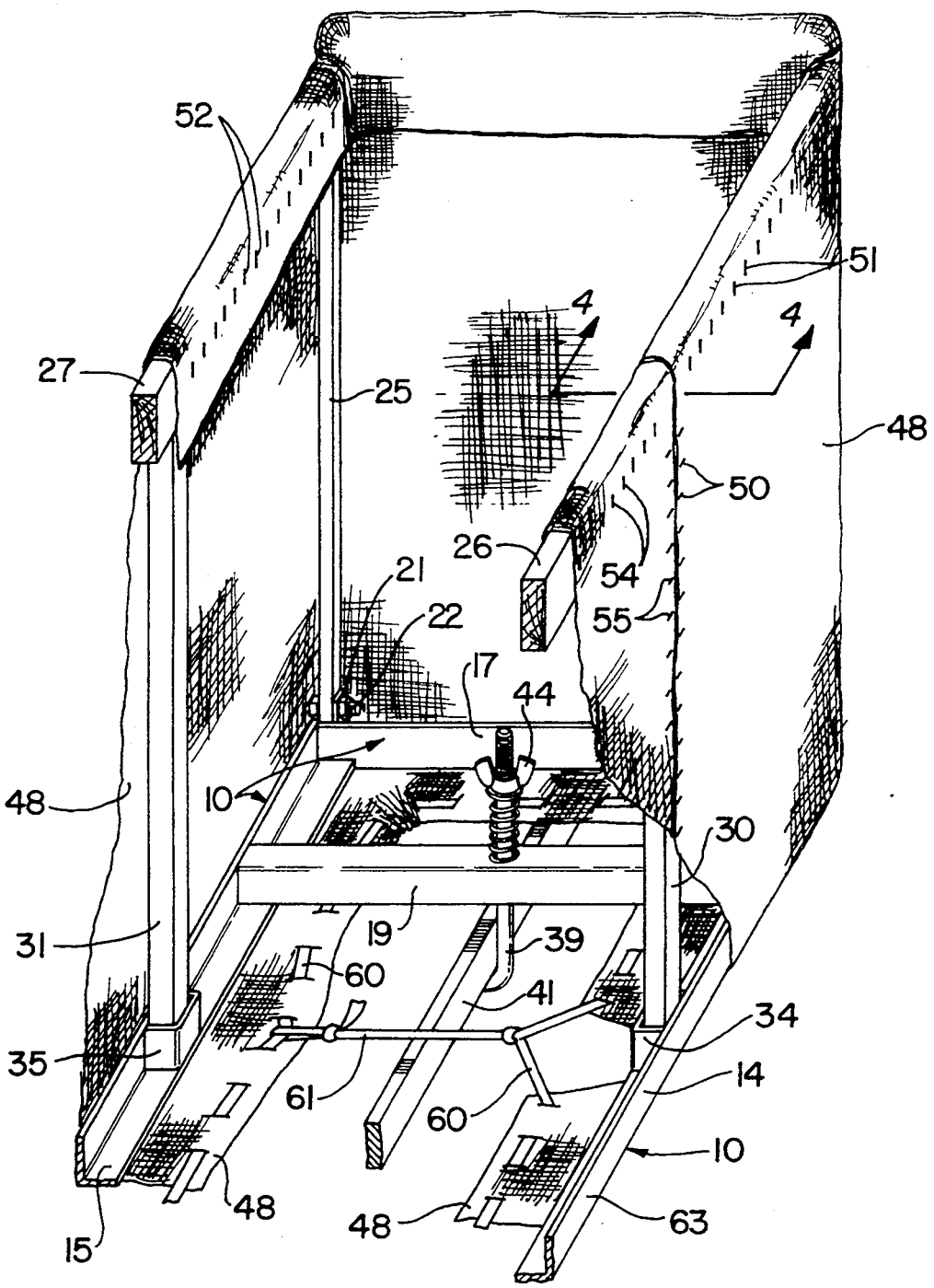
FIG. 1 is a broken away perspective view of the invention in use.

Once the frame is assembled with the wooden stakes 26, 27, 30, 31 in place, as seen in FIG. 3, the porous plastic silt barrier sheeting 48 can be applied to it as illustrated in FIG. 1. First, an end of the sheeting is lapped half way over one of the vertical wooden stakes, such as the stake 30, while the vertical position of the sheeting is adjusted to ensure sufficient material at the top of the frame to permit rolling it inside the horizontal wooden stakes and with sufficient material at the bottom of the frame to permit having the sheeting extend horizontally inwardly at the bottom of the frame. Specifically, the material is fastened by staples 50 to the vertical wooden stake 30 and then fastened with staples 51 to the outside of the horizontal wooden stake 26, and the material is stapled to the inside of the horizontal wooden stake 26 by staples not shown, then the material is wrapped around the end frame 25, it is stapled along the entire length of the horizontal wooden stake 27, on both the inside by staples 52 and outside by staples not shown. The material may also be stapled down the length of the vertical wooden stake 31 by staples not shown. The material is then wrapped around the end frame 24 and along the horizontal wooden stake 26, to which it would be fastened by staples 54 on the outside thereof and by staples (not shown) on the inside thereof, and it would then be cut so as to have an edge thereof abutting the edge which had previously been stapled by the staples 50; this edge is then stapled to the vertical wooden stake 30 by staples 55.

The material 48 typically comes supplied with a drawstring 60, which can be used to draw the material 48 horizontally inwardly, underneath the frame 10, by several inches, all the way around. Having this extra material extend horizontally inwardly across the bottom of the frame prevents the material from lifting up above the side of the frame as a result of being pulled upon by the accumulation of silt. In other words, it acts as a reservoir of material to ensure that the sheeting will always extend all of the way down to the frame 10, and thereby ensure blocking of the silt. The drawstring 60 can be tied from one side to the other in the center, as illustrated by the portion 61 thereof.

Figure 2:
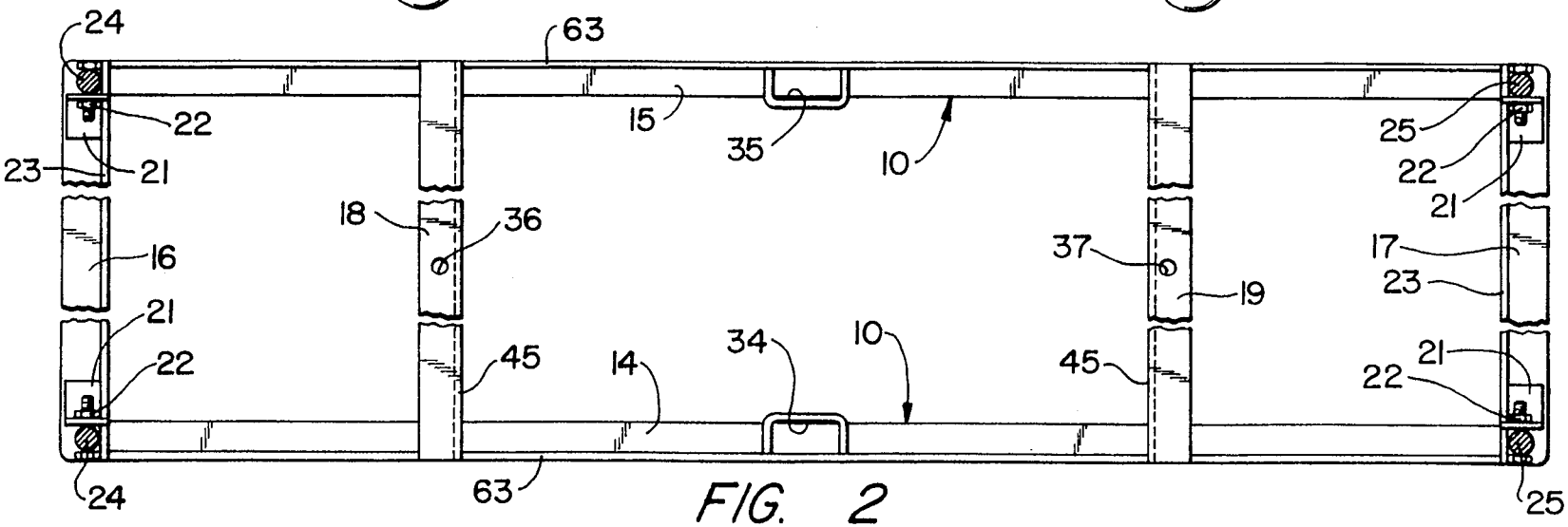
FIG. 2 is a broken away partly sectioned plane view of a frame in accordance with the invention.

The size of the frame will vary depending upon the culverts to which it is to be attached. Since a tight fit is desired, the frame should not extend onto rough pavement. The frame can be only an inch or so larger in each dimension than the culvert that it is to protect. Such frame structures when assembled as seen in FIG. 1 may typically be on the order of two feet wide (as seen in FIG. 2) and three feet long (as seen in FIG. 2 and FIG. 3). The porous plastic silt barrier sheeting 48 is typically about three feet wide. In such case, the frame structures may be on the order of two feet high (as seen in FIG. 3) to allow folding it over the horizontal wooden pieces 26, 27 at the top of the frame and to allow extending it horizontally inwardly under the frame by several inches, all the way around, as described hereinbefore. Of course, other sizes of frames and sheeting 48 may be selected to suit various uses of the invention. In the general case, the main frame is rectangular to fit common catch basins; but the shape may vary.

Figure 5:
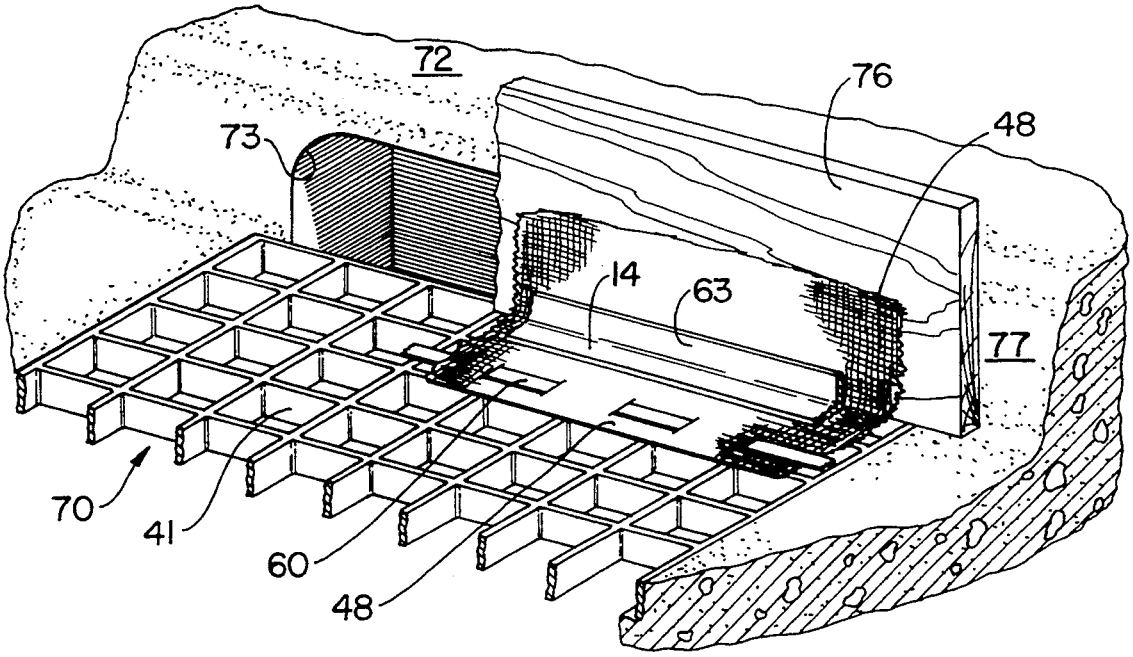
FIG. 5 is a partial, broken away perspective view of the invention holding a slab of wood against a curbside catch basin.
Figure 6:
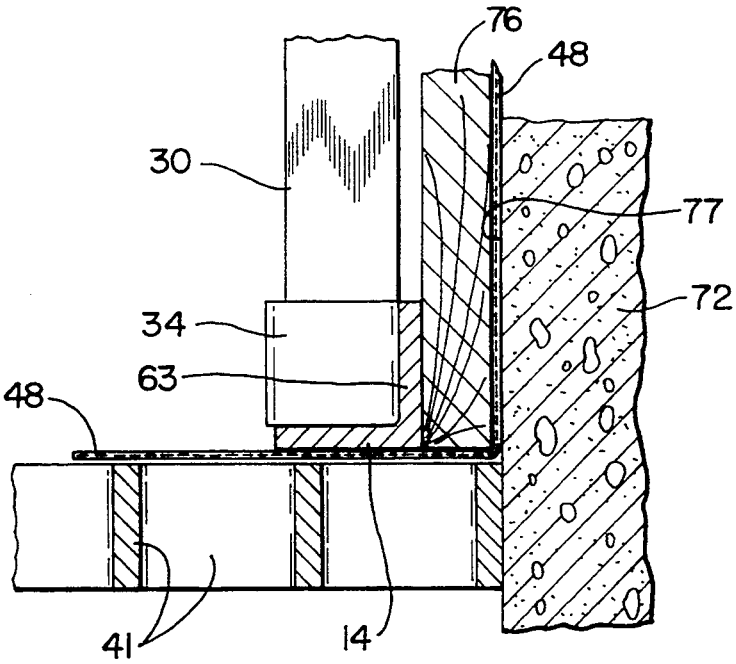
FIG. 6 is a partial, broken away sectioned view of a slab of wood between silt barrier sheeting and frame of the invention.

A curbside catch basin 70 (FIG. 5), formed integrally with a roadside curb 72, has a throat 73 (an open water passage) extending vertically upwardly from the grating 41 thereof, within the curb 72. The side pieces 14, 15 are disposed in the frame 10 with their vertical walls 63 disposed outwardly, rather than inwardly, of the frame 10. This is to facilitate supporting an auxiliary piece 76, such as a slab of plywood or the like, which may be laid up against the vertical surface 77 of the curb 72 to close off the throat 73 of the curbside catch basin 70 before the assembled frame is clamped to the grating 41. On the other hand, the slab 76 could be positioned (FIG. 6) inside the sheeting 48, between the sheeting 48 and the frame, e.g., frame member 30, and the assembly positioned tightly against the surface 77, with the slab adjacent to the throat 73, before the assembled frame is clamped to the grating 41.

Figure 4:
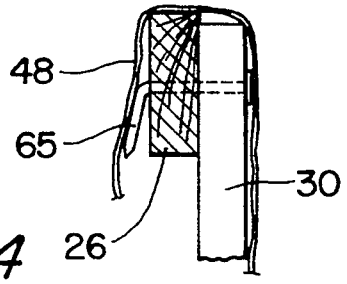
FIG. 4 is a simplified cross section taken on the line 4—4 in FIG. 1 illustrating an alternative to the construction of FIG. 3.

As shown in FIG. 4, the vertical wooden stakes 30 may be lapped over the horizontal stake 26 and joined therewith by a nail 65, which may be bent over to cause it to act more like a rivet, if desired. In such a case, after use, the vertical stake could be rotated into alignment with the horizontal stage 26 for transport and storage. Of course, the vertical stake 30 could be oriented inside the horizontal stake 26, instead of being outside thereof as shown in FIG. 4. Thus, a variety of features, or combinations thereof, may be used to ensure registration of the vertical wooden stakes 30, 31 with the horizontal wooden stakes 26, 27.

As a manufactured article in commerce, the silt barrier for catch basins incorporating the present invention will generally comprise a silt barrier subassembly including the main frame member 10 with the end frames 24, 25 pivotally disposed thereon, and the assemblies of the j-bolts 38, 39 in place. The wooden stakes 26, 27, 30, 31, the porous plastic barrier sheeting material 48, and the staples 50-52 would normally be provided on the construction site. The stakes 26, 27, 30, 31 typically comprise grade stakes, surveyor stakes or common silt barrier fence stakes generally provided at typical construction sites. On the other hand, any sort of scrap wood could be adapted on the site for use as frame members in assembling a silt barrier for catch basins utilizing the present invention. Similarly, materials other than steel may be used for the end frames, but steel is preferred for the main frame 10 to permit snugging it down hard against the grating 41. The side frames, formed in FIGS. 1–3 of stakes 26, 27, 30, 31 could instead be formed of metal if other means are used (such as sturdy clips) to hold the sheeting 48.

The end pieces 16, 17 may have the vertical walls thereof 23 oriented toward the outside of the frame, rather than toward the inside, provided some provision is made to ensure that the end frames 24, 25 will be blocked from rotating further outwardly at their tops.

The end frames could be fitted into sockets for use, rather than being pivoted, in which case the non-use position is achieved by disengaging the end frames from the main frame. Each end frame could consist of two separate vertical pieces with a separate horizontal spreader piece. However, a one piece subassembly as shown is far easier to handle and more durable.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A silt barrier subassembly for preventing silt from entering the mouth of a catch basin of the type having a generally horizontally disposed grating covering the mouth of the catch basin, comprising:

a pair of side rails joined at their ends by end rails forming a generally rectangular, hollow main frame;

a pair of end frame members rotatively disposed to said main frame in a manner to permit rotation from a folded position, in which the end frame members lie adjacent to said main frame, and an extended position in which said end frame members extend upwardly from said end rails generally perpendicular to said main frame; and means disposed on said main frame having a portion extending downwardly below said main frame movably with respect to said main frame and adapted to engage a portion of the grating of the catch basin for drawing said main frame downward toward the grating to secure said main frame tightly to said catch basin above said grating.

2. Apparatus according to claim 1, further comprising:

a pair of side frames, each extending between a corresponding side of said pair of end frames with said end frames in their extended positions.

3. Apparatus according to claim 2, wherein said side frames each include vertical and longitudinal pieces; and wherein said main frame member comprises means substantially symmetrically disposed on each of said side rails intermediate said end frames, each for registering a vertical portion of one of said side frames with respect to the related one of said side rails.

4. Apparatus according to claim 2, further comprising a sheet of porous plastic silt barrier material wrapped about said main frame, said end frames and said side frames so as to extend vertically from said main frame upwardly over said longitudinal pieces and over the top of said end frames.

5. Apparatus according to claim 4, wherein said side frames are made of wood.

6. Apparatus according to claim 5, wherein said porous plastic silt barrier material is stapled to said wooden side frame members.

7. Apparatus according to claim 4, wherein said sheet of porous plastic silt barrier material has a drawstring threaded along one longitudinal edge thereof, and said material is drawn horizontally inwardly of the bottom of said frame by means of said drawstring.

8. Apparatus according to claim 2, wherein said side frames each comprise a longitudinal piece having a vertical piece releasably registered therewith.

9. Apparatus according to claim 2, wherein said side frames each comprise a longitudinal piece having a vertical piece rotatively registered therewith.

10. Apparatus according to claim 1 wherein said means for securing said main frame to said grating comprises a j-bolt extending through said frame with the hook portion thereof extending downwardly in a manner to permit hooking the grating, and a nut on the j-bolt to permit drawing the frame tightly to the grating.

11. A silt barrier subassembly for preventing silt from entering the mouth of a catch basin of the type having a generally horizontally disposed grating covering the mouth of the catch basin, comprising:

a pair of steel side rails joined at their ends by steel end rails forming a generally rectangular, hollow main frame;

a pair of end frame members disposed on said main frame in a manner to permit movement from a non-use position, in which the end frame members do not extend outwardly of said main frame, to a use position in which said end frame members extend upward from said end rails generally perpendicular to said main frame; and means disposed on said main frame having a portion extending downwardly below said main frame movably with respect to said main frame and adapted to engage a portion of the grating of the catch basin for drawing said main frame downward toward the grating to secure said main frame tightly to said catch basin above said grating.

12. A method of blocking silt from entering the mouth of a catch basin having a generally horizontal grating across the mouth thereof, comprising:

establishing a frame having vertical portions extending upwardly from a horizontal, generally hollow main frame portion that is of a size and shape slightly larger than the mouth of the catch basin;

surrounding said vertical portions with porous plastic silt barrier sheeting;

securing said sheeting to said frame;

positioning said frame, with said sheeting secured thereto, above the grating of the catch basin with the mouth of the catch basin totally within said frame; and securing said frame tightly to said grating, whereby silt flowing toward the catch basin is blocked by said sheeting secured to said frame before reaching the mouth of the catch basin.

13. The method according to claim 12 including additional steps for accommodating a curbside catch basin formed integrally with a roadside curb and having an open throat extending vertically upward from said grating within said curb, said additional steps comprising:

placing a slab of material against the curb to block the throat of the catch basin; and positioning said frame member, after it is surrounded with said sheeting, tightly against said slab of material before securing said frame to said grating.

14. The method according to claim 12 including additional steps for accommodating a curbside catch basin formed integrally with a roadside curb and having an open throat extending vertically upward from said grating within said curb, said additional steps comprising:

after said frame member is surrounded by said sheeting, placing a slab of material vertically between said sheeting and said frame; and positioning said frame member, with said slab of material adjacent to the throat of the catch basin, tightly against the throat of the catch basin before securing said frame to said grating.

15. The method according to claim 12:

wherein said surrounding step comprises surrounding said vertical portions with porous plastic silt barrier sheeting which has a drawstring interlaced along a first one of two longitudinal edges thereof, with the second one of said longitudinal edges oriented vertically upwardly away from said said main frame; and wherein after securing said sheeting to said frame and before securing said frame to said grating, said sheeting is drawn toward the center of said main frame with said drawstring.

* * * * *